US009856711B2

(12) United States Patent
Nguyen

(10) Patent No.: US 9,856,711 B2
(45) Date of Patent: Jan. 2, 2018

(54) CONTROL LINE CONNECTION TECHNIQUE

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 669 days.

(21) Appl. No.: 14/475,328

(22) Filed: Sep. 2, 2014

(65) Prior Publication Data

US 2016/0060991 A1 Mar. 3, 2016

(51) Int. Cl.
*E21B 33/038* (2006.01)
*E21B 33/035* (2006.01)

(52) U.S. Cl.
CPC ..... *E21B 33/038* (2013.01); *E21B 33/0355* (2013.01)

(58) Field of Classification Search
CPC .... E21B 33/038; E21B 33/0355; E21B 33/03; E21B 33/068; E21B 33/072; E21B 33/076; E21B 34/16; E21B 34/00
See application file for complete search history.

(56) References Cited

U.S. PATENT DOCUMENTS

| | | | | |
|---|---|---|---|---|
| 4,090,565 | A | 5/1978 | McGee | |
| 4,181,175 | A | 1/1980 | McGee et al. | |
| 2005/0067167 | A1 | 3/2005 | Hall et al. | |
| 2009/0000781 | A1* | 1/2009 | Bolding | E21B 33/068 166/90.1 |
| 2009/0277646 | A1 | 11/2009 | Guven | |
| 2010/0206545 | A1 | 8/2010 | Nguyen | |
| 2013/0168104 | A1 | 7/2013 | Sinnott et al. | |

* cited by examiner

*Primary Examiner* — Wei Wang
(74) *Attorney, Agent, or Firm* — Eubanks PLLC

(57) ABSTRACT

A connection assembly for connecting a control line to a component is provided. In one embodiment, a system includes a control line coupled to a tubing hanger with a connection assembly. The connection assembly includes a first fitting connected to the control line and to the tubing hanger, with the first fitting sealing against the control line and the tubing hanger, and a main body disposed about the control line and connected to the tubing hanger with the main body sealing against the tubing hanger. The connection assembly also includes a second fitting connected to the control line and to the main body so as to seal against the control line and the main body, an internal cavity, and a test port. Additional systems, devices, and methods are also disclosed.

16 Claims, 5 Drawing Sheets

CONTROL LINE CONNECTION TECHNIQUE

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Wells can also include tubing strings that facilitate flow of fluids through the wells. Hangers can be attached to the casing and tubing strings and received within wellheads to enable these tubular strings to be suspended in the wells from the hangers. Various components can also be provided in the well below the hangers. Control lines can be used to facilitate electronic or fluid communication with such components, and in some instances the control lines are coupled to the wellhead hangers.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to connection assemblies for coupling control lines to other components, such as wellhead hangers. In some instances, the control lines are coupled to tubing hangers and used to control downhole components within the well. The connection assemblies can include hydraulic fittings for securing the control lines to the tubing hangers. In one embodiment, a connection assembly includes a pair of fittings coupled to a control line and a main body disposed about the fittings. One of the fittings is connected to seal against the tubing hanger, one end of the main body is also connected to seal against the tubing hanger, and the other fitting is connected to seal against the other end of the main body. Proper fitting of the components during installation can be verified by a pressure test within an internal cavity of the connection assembly.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
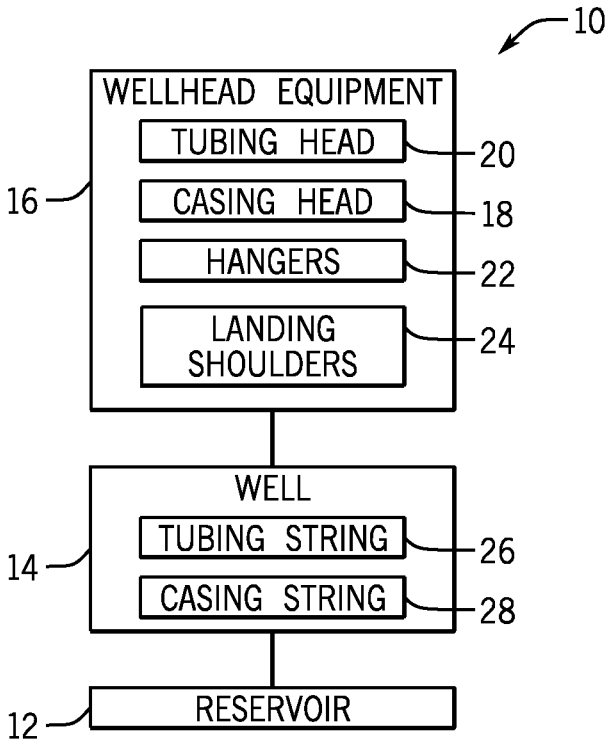
FIG. 1 generally depicts various components, including one or more tubular strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as wellhead hangers 22. But the components of the wellhead equipment 16 can differ between applications, and could include a variety of casing heads, tubing heads, spools, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the tubing and casing heads). These landing shoulders 24 can be integral parts of tubing and casing heads or can be provided by other components, such as sealing assemblies or landing rings disposed in the tubing and casing heads. Each of the hangers 22 can be connected to a tubular string, such as a tubing string 26 or a casing string 28, to suspend the string within the well 14. The well 14 can include a single casing string 28 or include multiple casing strings 28 of different diameters.

Various downhole devices can be used within the well 14 to facilitate desired well operations. Examples of such downhole devices include safety valves, other valves, chemical injection units, and sensors. In some instances, control lines are connected to such downhole devices to enable fluid or electrical communication with the devices. The control lines could be provided as fluid lines (e.g., for control of a hydraulically actuated component, such as a valve, or for routing chemicals to a chemical injection unit) or as electrical lines (e.g., for communication with an electric valve or sensor).

Figure 2:
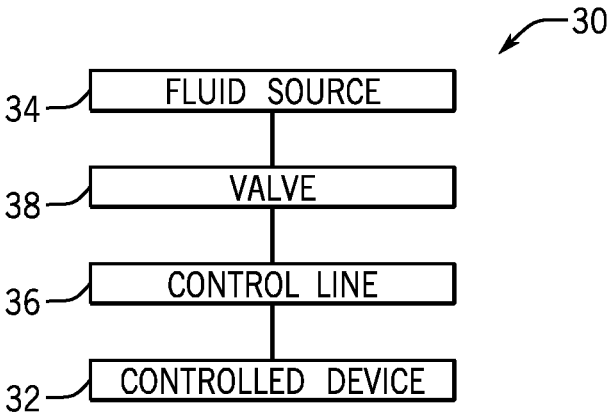
FIG. 2 generally depicts a control system having a control line coupled to a device, such as a downhole valve, in accordance with one embodiment.

One example of a control system 30 is generally depicted in FIG. 2. In some embodiments, a controlled device or component 32 is operated by a fluid (e.g., a hydraulic control fluid) provided from a fluid source 34 through a control line 36. The control line 36 can extend down the well 14 to a downhole device 32. A supply valve 38 can be used to control the flow of fluid from the source 34 to the device 32.

In some instances, one or more control lines 36 can extend down the well 14 from a hanger 22 along a tubular string (e.g., tubing string 26). The hanger 22 can include conduits that facilitate fluid or electrical communication between downhole components below the hanger 22, such as a controlled device 32, and other components above the hanger 22, such as a fluid source 34 or electronic control system. Control lines 36 can be routed through the conduits of the hanger 22. In other instances, the control lines 36 (e.g., hydraulic control lines) can terminate at the hanger 22 to allow fluid to flow through conduits of the hanger 22 to the control lines 36. Whether the control lines 36 are provided continuously through the conduits of the hanger 22 or terminate at the conduits, the control lines 36 can be coupled to the hanger 22 with connection assemblies. These connection assemblies can provide a seal between the control line 36 and the hanger 22 to inhibit fluid leakage at the connection.

Figure 3:
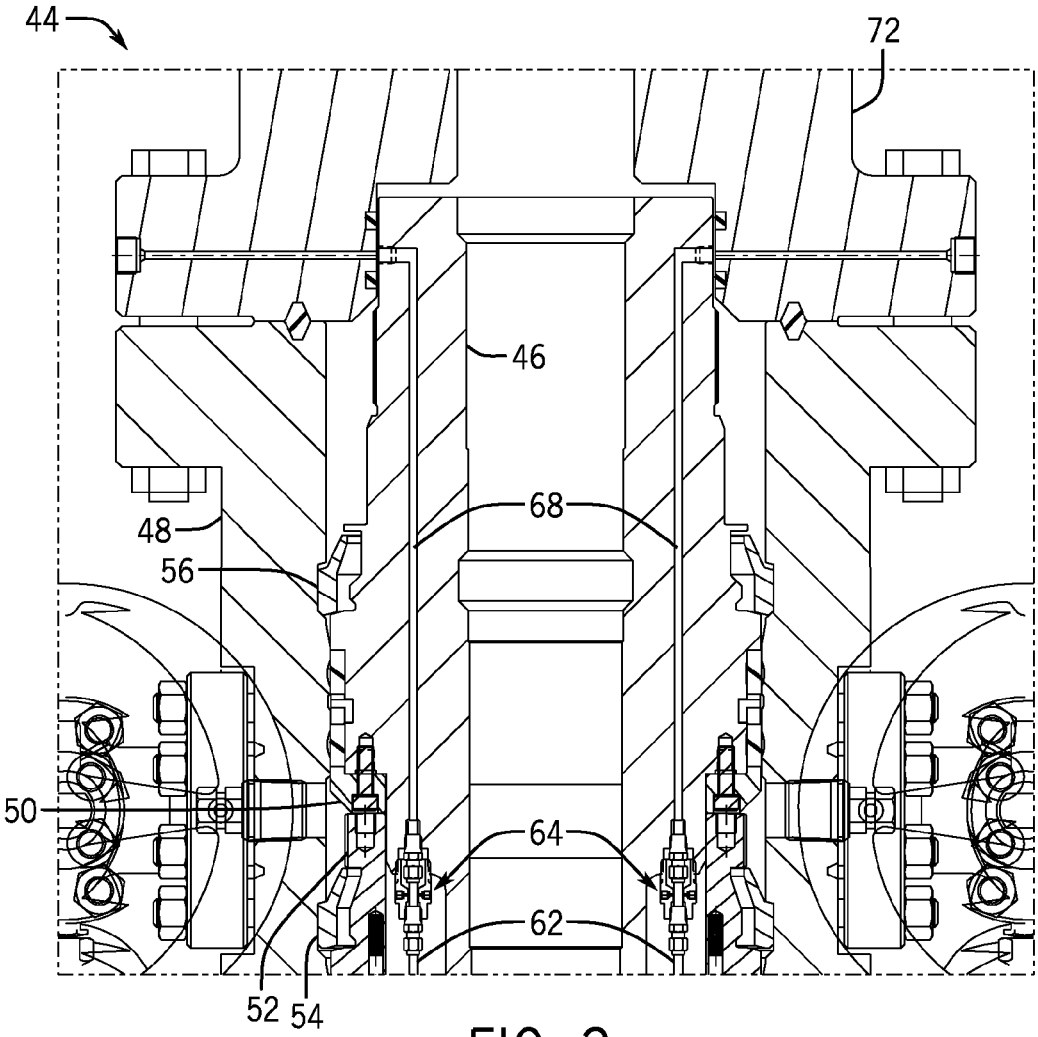
FIG. 3 depicts a wellhead apparatus having control lines coupled to a tubing hanger with connection assemblies in accordance with one embodiment.

By way of example, a wellhead apparatus 44 with connection assemblies coupling control lines to a tubing hanger is depicted in FIG. 3 in accordance with one embodiment. As shown, a tubing hanger 46 is disposed within a tubing head 48 and includes a shoulder 50 landed on a packoff 52. Locking rings 54 and 56 are used to secure the packoff 52 and the tubing hanger 46 within the bore of the tubing head 48. Control lines 62 are coupled to the lower end of the tubing hanger 46 with connection assemblies 64, which may also be referred to as plug assemblies or termination assemblies. As generally described above, in at least some embodiments the connection assemblies 64 seal the control lines 62 to the tubing hanger 46 to inhibit fluid leakage through the connection. Lower ends of the control lines 62 can be coupled to downhole components 22.

In the depicted embodiment, the control lines 62 are hydraulic control lines coupled in fluid communication with conduits 68 in the tubing hanger 46. This allows hydraulic control fluid (e.g., from a fluid source 34) to be pumped into the control lines 62 through the conduits 68 to control the operation of hydraulic downhole components 32. In other instances, one or more of the control lines 62 could be chemical injection lines in fluid communication with a downhole chemical injection unit. Desired fluids can be introduced to the conduits 68, such as through external ports of a spool or other component 72 attached to the tubing head 48. Although two control lines 62 are depicted in FIG. 3, it will be appreciated that the wellhead apparatus 44 in practice could include more or fewer control lines 62.

Figure 4:
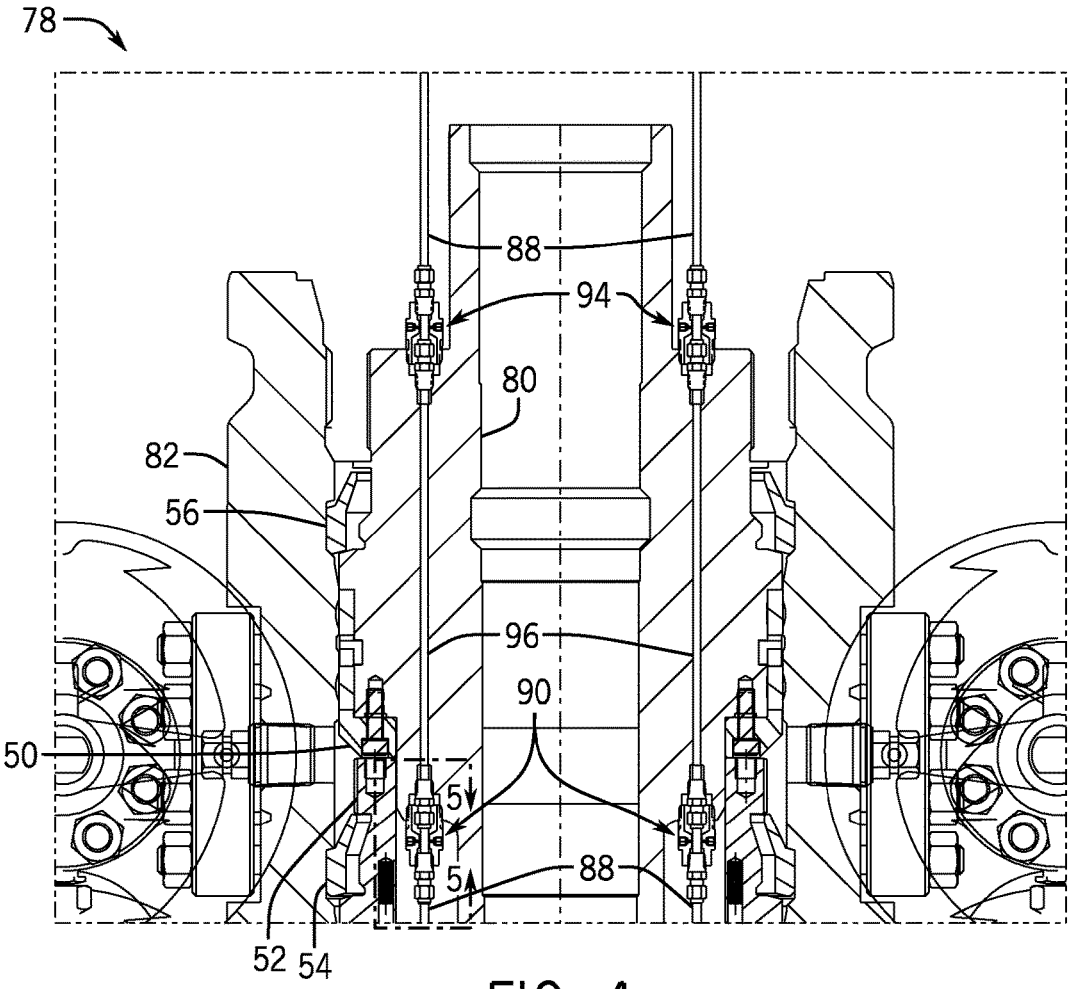
FIG. 4 depicts another wellhead apparatus having control lines coupled to a tubing hanger via connection assemblies in accordance with one embodiment.

Another example of a wellhead apparatus 78 is depicted in FIG. 4. In this embodiment, a tubing hanger 80 is installed in a tubing head 82 with its shoulder 50 landed on a packoff 52. As in the previous example, locking rings 54 and 56 are used to secure the packoff 52 and the tubing hanger 80 within the bore of the tubing head 82, but it will be appreciated that components in the bore of a wellhead can be secured in other ways.

Control lines 88 are coupled to the tubing hanger 80 with control line connection assemblies 90 and 94. More specifically, a first pair of control lines 88 is shown here coupled to the tubing hanger 80 with lower connection assemblies 90 and a second pair of control lines 88 is shown coupled to the tubing hanger 80 with upper connection assemblies 94. The connection assemblies 90 and 94 are coupled to opposite ends of conduits 96 through the tubing hanger 80 so that the upper and lower control lines 88 are in fluid communication through the conduits 96. Although not depicted here, other components can be coupled above the tubing head 82 and the upper control lines 88 can extend through such other components and be coupled to a fluid source 34. Fluid from the source 34 can be fed through the fluid lines 88 and the conduits 96 to downhole components 32, as described above. And like apparatus 44, the wellhead apparatus 78 could include more or fewer control lines 88 than those depicted in FIG. 4.

Figure 5:
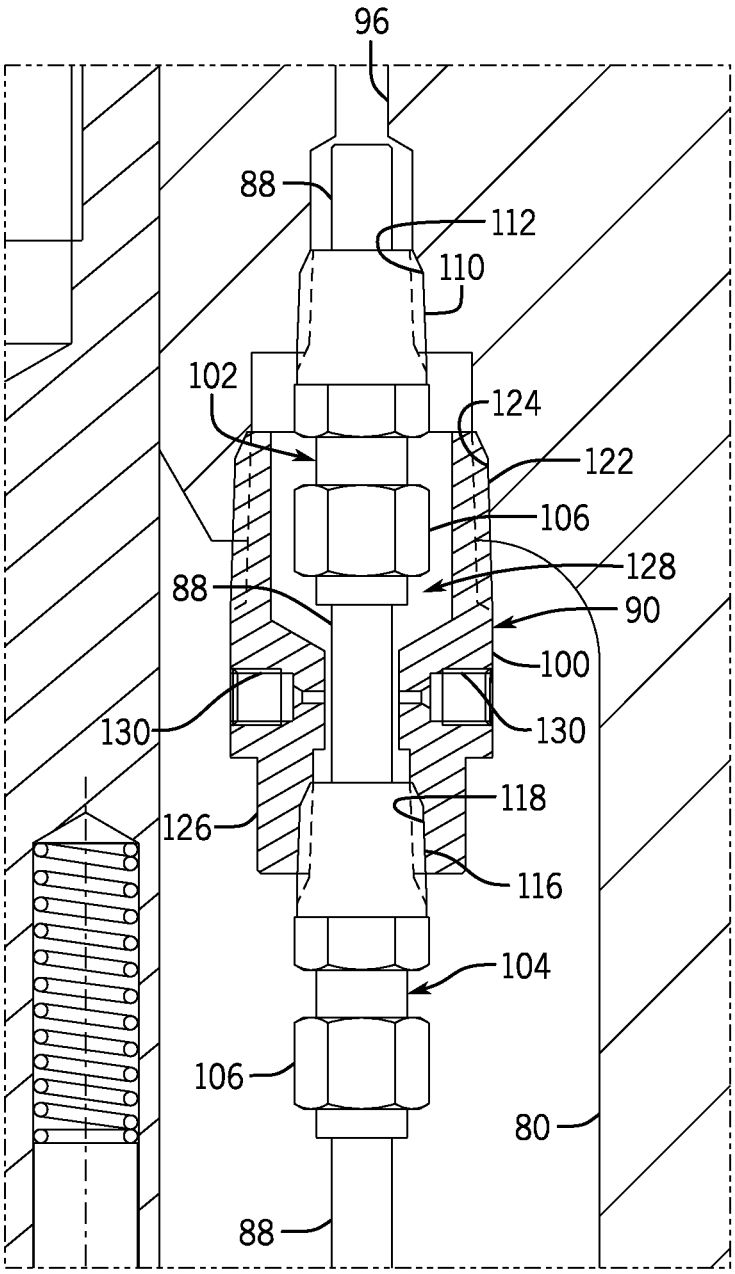
FIGS. 5 and 6 are detail views of one of the connection assemblies of FIG. 4, showing various components of the connection assembly in accordance with one embodiment.
Figure 6:
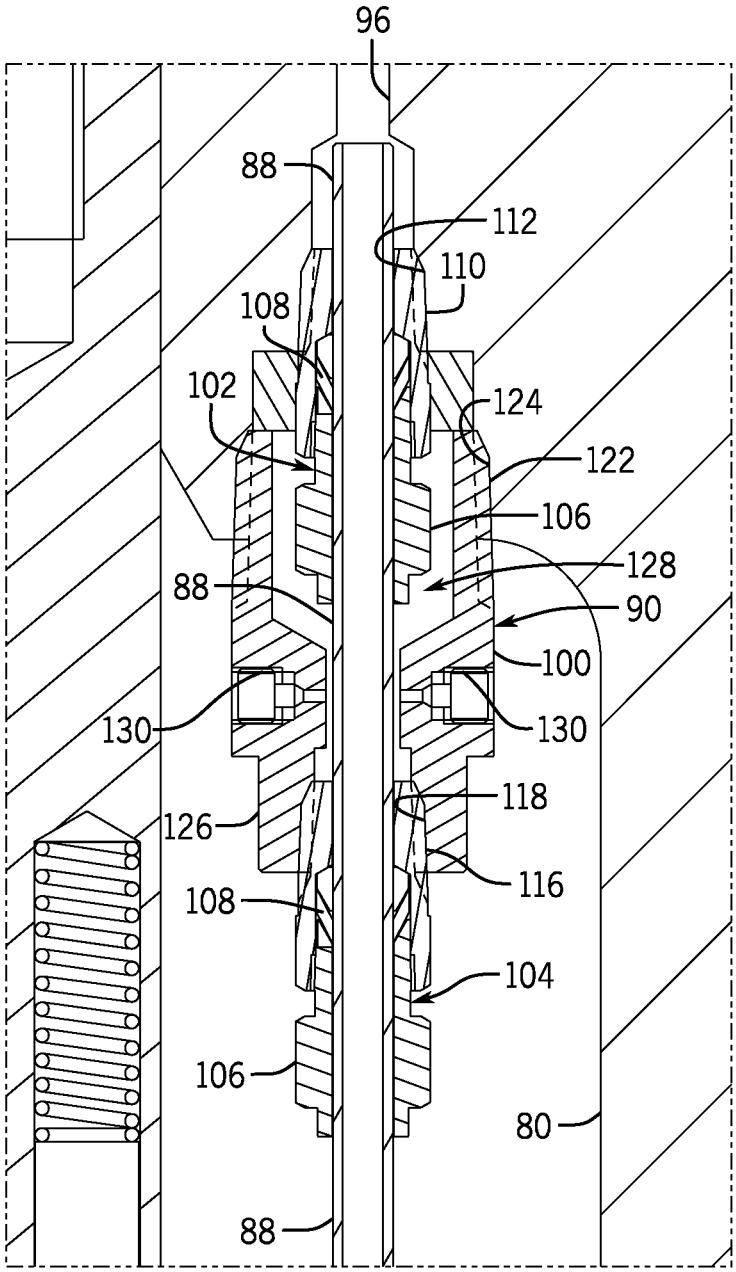

One of the control line connection assemblies 90 is shown in greater detail in FIGS. 5 and 6. Although only one of the connection assemblies 90 is shown in these two figures by way of example, the connection assemblies 64, 90, and 94 can share the same features and could even be identical. But in other embodiments some or all of the connection assemblies 64, 90, and 94 could take other forms and could differ from one another. Further, although the connection assemblies 64, 90, and 94 are shown as connecting control lines to tubing hangers, it will be appreciated that the connection assemblies 64, 90, and 94 could be used to couple lines (e.g., hoses or tubes) to other types of hangers or to other oilfield or non-oilfield components.

As depicted in FIGS. 5 and 6, the connection assembly 90 is a termination assembly in that it is attached to the end of a control line 88 and couples the control line 88 to the tubing hanger 80. The connection assembly 90 includes a main body 100, which can also be referred to as a collar or plug 100, connected to the tubing hanger 80. The connection assembly 90 also includes fittings 102 and 104 (e.g., hydraulic fittings) disposed about and connected to the control line 88. The fittings 102 and 104 could be connected to the control line 88 in any suitable manner. As illustrated in FIGS. 5 and 6, the fittings 102 and 104 include nuts 106 that can be rotated to advance into opposing pieces, causing seals 108 (e.g., metal seals) of the fittings to energize and grip the control line 88. The seals 108 inhibit fluid flow through the fittings 102 and 104 along the exterior of the control line 88.

The main body 100, the fitting 102, the fitting 104, and the tubing hanger 80 can be coupled together in any suitable fashion. As presently shown, the fitting 102 and the main body 100 are received in concentric recesses of and coupled to, the tubing hanger 80, while the fitting 104 is connected to the main body 100. More specifically, as presently depicted, the fitting 102 is coupled to the tubing hanger 80 by mating threaded surfaces 110 and 112, the main body 100 is coupled to the tubing hanger 80 by mating threaded surfaces 122 and 124, and the fitting 104 is coupled to the main body 100 by mating threaded surfaces 116 and 118. In at least some embodiments, these mating threaded surfaces are constructed to provide fluid-tight seals so that the fitting 102 seals against the tubing hanger 80 (via threaded surfaces 110 and 112), the main body 100 seals against the tubing hanger 80 (via threaded surfaces 122 and 124), and the fitting 104 seals against the main body 100 (via threaded surfaces 116 and 118). These threaded surfaces can have any suitable threads (e.g., National Pipe Tapered (NPT) threads) and a sealant compound could be used to aid sealing of the threaded surfaces to one another.

The control line 88 can be coupled to the tubing hanger 80 with the connection assembly 90 before the tubing hanger 80 is lowered into the tubing head 82. Once made up, this connection can also be tested for proper seating of the components (e.g., to verify sealing) before running the tubing hanger 80 into the tubing head 82. The components of the connection assembly can be installed in any suitable manner. As an example, the fittings 102 and 104 and the main body 100 can be slipped onto the control line 88, the fitting 102 can be threaded into the tubing hanger 80, one end of the main body 100 can be threaded into the tubing hanger 80, and the fitting 104 can be threaded into the opposite end of the main body 100. The main body 100 can include a hexagonal exterior surface 126 to facilitate installation (e.g., by a wrench or by hand). The fittings 102 and 104 can be tightened by turning the nuts 106 to grip and seal against the control line 88. It will be appreciated that the fitting 102 can be tightened on the control line 88 before threading the main body 100 into the tubing hanger 80.

As depicted in FIGS. 5 and 6, an enclosed, internal cavity 128 is defined by the main body 100, the tubing hanger 80, and the fittings 102 and 104. Once the connection assembly 90 is made up, one or more test ports 130 in fluid communication with the cavity 128 can be used to verify proper seating of the main body 100 and the fittings 102 and 104. More specifically, a pressure test can be conducted via the test ports 130 to verify adequate sealing at the connections between: the fitting 102 and the tubing hanger 80, the main body 100 and the tubing hanger 80, and the fitting 104 and the main body 100. For instance, the cavity 128 can be pressurized (or depressurized) and monitored via the test ports 130 to determine whether the connection assembly is leaking. During the test, the internal cavity 128 is generally isolated from an external environment by the sealing engagement of the components of the connection assembly 90. Consequently, a leak in the connection assembly can be indicated by changes in the pressure within the internal cavity 128 during the pressure test. In this way, the connection assembly 90 facilitates testing of the connection of the control line 88 to the tubing head 80 and enables verification of sealing engagement of the fitting 102 with the control line 88 and the tubing hanger 80, of the main body 100 with the tubing hanger 80, and of the fitting 104 with the control line 88 and the main body 100.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a tubing hanger; and a control line coupled to the tubing hanger with a control line connection assembly, the control line connection assembly including:

a first fitting disposed about the control line and connected to the control line and to the tubing hanger such that the first fitting seals against both the control line and the tubing hanger;

a main body disposed about the control line and connected to the tubing hanger such that the main body seals against the tubing hanger, wherein the main body is connected to the tubing hanger via mating threaded surfaces; and a second fitting disposed about the control line and connected to the control line and to the main body such that the second fitting seals against both the control line and the main body;

an internal cavity defined by the main body, the tubing hanger, the first fitting, and the second fitting; and a test port connected in fluid communication with the internal cavity.

2. The system of claim 1, wherein the test port enables verification of sealing engagement of the first fitting with the control line and the tubing hanger, of the main body with the tubing hanger, and of the second fitting with the control line and the main body.

3. The system of claim 2, wherein the test port is provided in the main body.

4. The system of claim 1, wherein the first fitting is connected to the tubing hanger via mating threaded surfaces.

5. The system of claim 1, wherein the second fitting is connected to the main body via mating threaded surfaces.

6. The system of claim 1, wherein the control line is in fluid communication with an internal conduit of the tubing hanger.

7. The system of claim 1, comprising an additional control line coupled to the tubing hanger with an additional control line connection assembly.

8. The system of claim 1, wherein the control line is coupled to a hydraulically actuated component disposed in a well.

9. A system comprising:

a tubing hanger;

a control line coupled to the tubing hanger with a control line connection assembly, the control line connection assembly including:

a first fitting disposed about the control line and connected to the control line and to the tubing hanger such that the first fitting seals against both the control line and the tubing hanger;

a main body disposed about the control line and connected to the tubing hanger such that the main body seals against the tubing hanger; and a second fitting disposed about the control line and connected to the control line and to the main body such that the second fitting seals against both the control line and the main body;

an internal cavity defined by the main body, the tubing hanger, the first fitting, and the second fitting;

a test port connected in fluid communication with the internal cavity; and an additional control line coupled to the tubing hanger with an additional control line connection assembly, wherein the control line and the additional control line are in fluid communication with one another via an internal conduit of the tubing hanger.

10. A system comprising:

a tubing hanger; and a control line connection assembly comprising:

a plug including a first threaded end, which is configured to be coupled to the tubing hanger, and a second threaded end;

a hydraulic fitting including a threaded end configured to be coupled to the second threaded end of the plug; and an additional hydraulic fitting including a threaded end configured to be coupled to the tubing hanger;

wherein the plug includes a test port in fluid communication with an interior of the plug, the first threaded end of the plug is screwed into a first recess of the tubing hanger, and the threaded end of the additional hydraulic fitting is screwed into a second recess of the tubing hanger that is concentric with the first recess.

11. The system of claim 10, wherein the hydraulic fitting and the additional hydraulic fitting are coupled to a control line, and the threaded end of the hydraulic fitting is coupled to the plug so as to define an enclosed cavity within the plug and the tubing hanger, the enclosed cavity including the interior of the plug.

12. A method comprising:

connecting a first hydraulic fitting on a control line to a wellhead hanger;

connecting a plug disposed about the control line to the wellhead hanger;

connecting a second hydraulic fitting on the control line to the plug;

using a test port in the plug to verify proper sealing at: the connection between the first hydraulic fitting and the wellhead hanger, the connection between the plug and the wellhead hanger, and the connection between the second hydraulic fitting and the plug; and lowering the wellhead hanger into a wellhead after using the test port in the plug to verify the proper sealing.

13. The method of claim 12, wherein connecting the first hydraulic fitting on the control line to the wellhead hanger includes threading the first hydraulic fitting into the wellhead hanger.

14. The method of claim 13, wherein connecting the plug to the wellhead hanger includes threading the plug into the wellhead hanger such that an end of the first hydraulic fitting is received within an internal cavity inside the plug.

15. The method of claim 12, comprising tightening the first and second hydraulic fittings to grip and seal against the control line.

16. The method of claim 15, wherein connecting the plug to the wellhead hanger includes connecting the plug to a tubing hanger.

* * * * *